US005649590A

United States Patent [19]

Andrieux et al.

[11] Patent Number: 5,649,590

[45] Date of Patent: Jul. 22, 1997

[54] BUNDLE OF TUBES FOR A STEAM CONDENSER

[75] Inventors: Bernard Andrieux, Boulogne; Daniel Carpentier, Neuilly Sur Marne, both of France

[73] Assignee: GEC Alsthom Delas, Levallois-Perret, France

[21] Appl. No.: 600,766

[22] Filed: Feb. 13, 1996

[30] Foreign Application Priority Data

Feb. 23, 1995 [FR] France ..... 95 02127

[51] Int. Cl.[6] ..... F28B 1/00

[52] U.S. Cl. ..... 165/110; 165/111

[58] Field of Search ..... 165/110, 111, 165/DIG. 910

[56] References Cited

U.S. PATENT DOCUMENTS 3,139,926 7/1964 Tinker .

FOREIGN PATENT DOCUMENTS 1391661 2/1965 France .

OTHER PUBLICATIONS

A. Christ, "Dampfgassen Und Entluftungsstellen in Kondensatoren", *Schweizerische Bauzeitung*, vol. 79, No. 46, Nov. 16, 1961, Zurich, pp. 828–834.

*Primary Examiner*—Henry A. Bennett
*Assistant Examiner*—Gregory A. Wilson
*Attorney, Agent, or Firm*—Sughrue, Mion, Zinn, Macpeak & Seas

[57] ABSTRACT

A tube bundle for a steam condenser in which the projection on a plane perpendicular to the axis of the tubes of the envelope of the tube-containing zones of the bundle forms a trace of the type forming radiating spikes, wherein at least some of the spikes split at least once into branches, and wherein said spikes radiate from a tube-containing area that forms a substantially circular ring.

5 Claims, 4 Drawing Sheets

BUNDLE OF TUBES FOR A STEAM CONDENSER

The present invention relates to a bundle of tubes for a steam condenser in which the projection onto a plane perpendicular to the axis of the tubes of the envelope of the tubed zones in the bundle forms a trace of the type forming radiating spikes.

BACKGROUND OF THE INVENTION

French patent No. 1 391 661 describes a bundle of tubes of this type.

In such a bundle, there exists a tube-free notch of triangular shape between each radiating spike constituting a tube-containing zone. Such a notch is necessary to allow steam to pass towards the tubes of two spikes situated on either side of the notch. A notch can thus be said to "feed" the tubes in two half-spikes on either side of the notch.

The total cross-section occupied by a bundle is a function of:

- the section of the tube-containing zone which depends on the number of tubes and on the pitch of the tubes;
- the section required for said notches that pass steam between the spikes; and
- the section of the tube-free zones that result from constraints on the trace: e.g. around the tube-containing zone referred to as the "air cooler".

For a given constant speed V in meters per second (m/s) of the steam along a flow notch between two spikes, a given length L in meters (m) of the tubes, and a given flow rate $q_i$ in cubic meters per second ($m^3/s$) of steam condensed per tube, which is the same for all of the tubes, it can be shown by calculation that the section S required for a triangular notch is equal to ½H (where l is the width of the notch: i.e. the distance between two spikes at their ends, and where H is the height of the notch, corresponding to the height of the two half-spikes on either side of the notch), and is also given by $S=NH(q_i/2LV)$ where N=the number of tubes in the two half-spikes fed by the triangular notch of height H.

It can thus be seen that the section required for a notch, which is a tube-free area required for passing steam towards the two half-spikes on either side of the notch, is proportional to the number N of tubes in the two adjacent half-spikes and to the height H of the notch.

It is therefore clear that large bundles having long spikes, and thus long notches, require a greater tube-free area per tube than do smaller bundles having shorter spikes.

Thus, for given steam speed V, the number of tubes that can be installed per unit area decreases with increasing height H of the triangular steam notches.

Unfortunately, the power exchanged in a bundle of tubes is proportional to the heat exchange surface area, and thus to the number of tubes.

OBJECTS AND SUMMARY OF THE INVENTION

An object of the present invention is to thus to enable the tube-containing zone to achieve a better filling coefficient relative to the total section of the bundle, thereby reducing the dimensions of the bundle of tubes for a given number of tubes and improving the heat exchange performance of the bundle, with this being done by giving the bundle a new trace.

The invention thus provides a tube bundle for a steam condenser in which the projection on a plane perpendicular to the axis of the tubes of the envelope of the tube-containing zones of the bundle forms a trace of the type forming radiating spikes, wherein at least some of the spikes split at least once into branches, and wherein said spikes radiate from a tube-containing area that forms a substantially circular ring.

According to another characteristic, the branching spikes comprise a base trunk which flares and splits into two branches of equal thickness as soon as the thickness of the trunk of the spike has reached between one-and-a-half and two times the thickness of its base.

Advantageously, the thickness of said tube-containing area forming a ring is substantially constant.

According to another characteristic, a tube-containing area of trapezium-shape referred to as the "air cooler" is surrounded by a cowling with the exception of its bottom face, and is situated inside said tube-containing ring, a tube-free annular area separates said trapezium-shaped area from said tube-containing ring, said tube-containing ring includes a gap into which the top end of said cowling penetrates, leaving clearance for communication between the tube-free annular area and a tube-free steam-passing notch between two spikes, and said cowling communicates with a few extraction pipes passing through said notch.

BRIEF DESCRIPTION OF THE DRAWINGS

There follows a description of various embodiments of the invention given with reference to the accompanying drawings, in which.

MORE DETAILED DESCRIPTION

Figure 1:
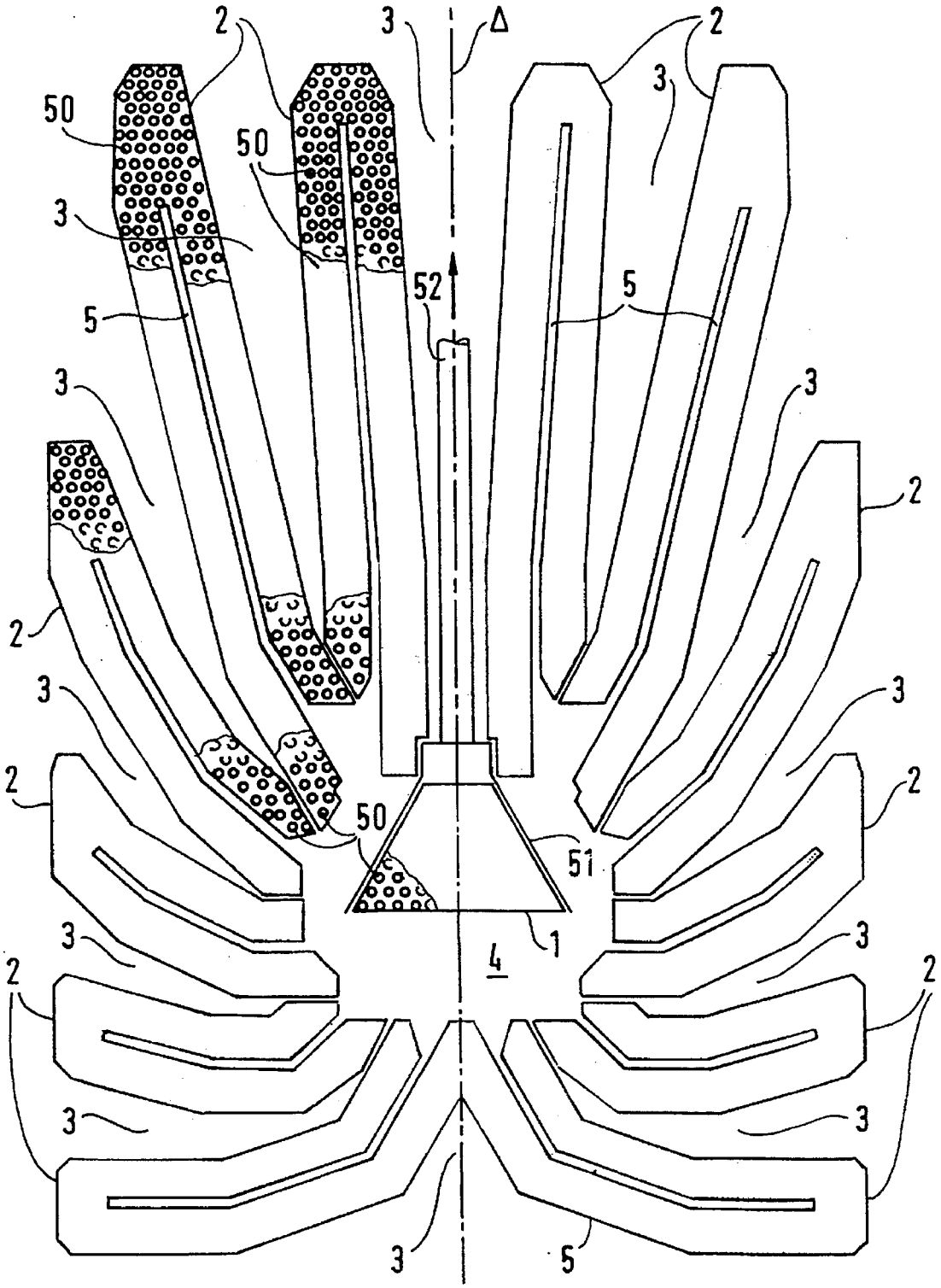
FIG.1 PRIOR ART
FIG. 1 shows the trace of a bundle of tubes in a prior art steam condenser.

Thus, FIG. 1 shows the trace of a bundle of tubes for a steam condenser. This is a prior art bundle of the radiating-spike type.

In a plane perpendicular to the axis of the tubes 50 (which are all parallel), the trace constitutes the envelopes of the tube-containing zones. This plane is parallel to the end tube plates.

The bundle comprises a first tube-containing zone 1 referred to as an air cooler, which is in the form of an isosceles trapezium and which is surrounded, with the exception of the bottom face of the air cooler, by a cowling represented by a single line 51. Around the air cooler there is situated a second tube-containing zone forming a plurality of radiating spikes 2. Outside these closed traces, the surface is tube-free, in particular in steam-passing notches 3 of substantially triangular section between consecutive pairs of spikes, and also a zone 4 around the air cooler 1 between the air cooler and the bases of the spikes 2.

The air cooler 1 serves to concentrate uncondensables (air) in order to enable them to be extracted by vacuum pumps. To this end, the cowling 51 communicates with a few extraction pipes 52 that pass through the top notch 3.

In the trace of FIG. 1, and also in the other figures, only a few tubes 50 are shown in each tube-containing zone, with the remainder of said tube-containing zones being shaded gray.

Each half-spike 2 is "fed" with steam from the adjacent notch 3. Each of the spikes 2 also includes a narrow tube-free notch 5 (generally as wide as a single row of tubes) subdividing the spike into two half-spikes.

It can be seen that some spikes 2, in particular the top spikes, are very long and are fed by deep steam-passing notches 3, which is unfavorable, as described above, since the tube-free triangular section 3 required for passing steam is proportional to the height H of the notches, and thus to the lengths of the spikes.

Figure 2:
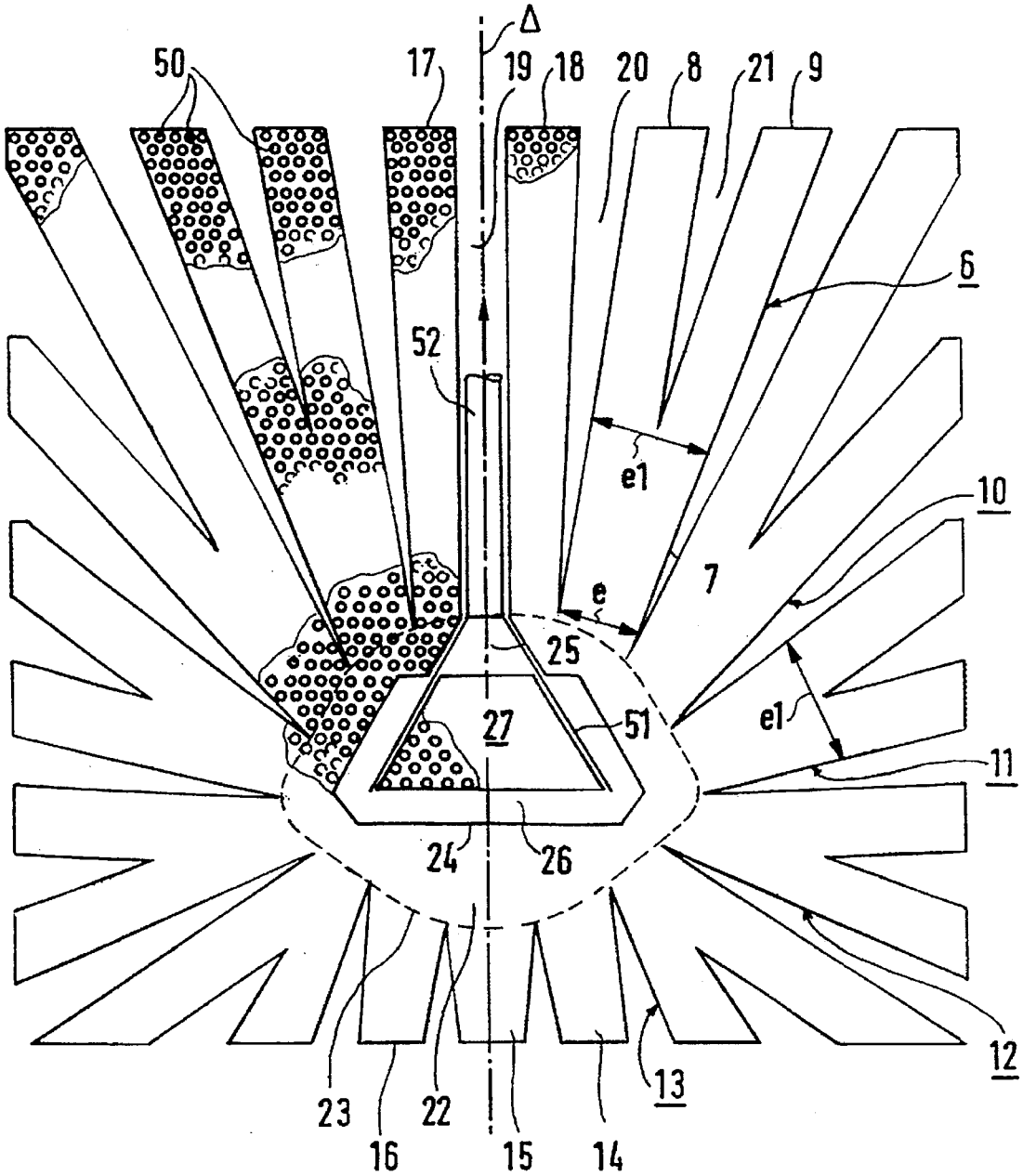
FIGS. 2, 3, and 4 show the traces of three bundles of tubes of the invention for three different examples of height/width ratio.

FIG. 2 shows the trace of a bundle of tubes of the invention for a height over width ratio equal to unity.

This bundle is likewise of the radiating spike type, but it includes the essential feature of the invention that some (most, but not all) of the spikes are split into branches.

Thus, by way of example, it can be seen that spike 6 has a trunk 7 which flares away from its base and then splits into two branches 8 and 9. The split into two branches takes place when the trunk 7 reaches a width $e_1$ lying in the range one-and-a-half to two times the thickness e of its base. The thickness of the two branches 8 and 9 is the same and it remains more or less constant. The same applies to the spikes 10, 11, 12, and 13 and to the spikes that are disposed symmetrically about the axis Δ.

The bottom spikes 14, 15, and 16 are not split, but they are very short. Similarly, the top two spikes 17 and 18 are not split, but they are spaced apart by a rectangular tube-free notch 19.

The other tube-free notches for passing steam are triangular in shape. This applies, for example, to the notch 20 between spike 18 and spike 6, and also to notch 21 between the two branches 8 and 9 of spike 6.

Another feature of the invention consists in the radiating spikes radiating from a tube-containing area in the form of a ring 22. A dashed line 23 serves merely to help visualize this ring which lies between said line 23 and the line 24 that actually forms part of the trace of the envelope of the tubes. The thickness of this ring is substantially constant, while nevertheless being a little thicker in its bottom portion.

As in the prior art of FIG. 1, there exists a tube-containing zone of trapezium-shape 27 constituting the air cooler (1 in FIG. 1). With the exception of its bottom face, this air cooler is surrounded by a cowling, represented by a single line 51. The tube-containing ring 22 includes a notch 25 into which the top end of the cowling 51 penetrates. Clearance between the cowling 51 and the tube-containing ring 22 provides steam-passing communication between the notch 19 and the tube-free annular surface 26 situated between the air cooler 27 and the tube-containing ring 22. The cowling 51 includes a few extraction pipes 52 passing through the notch 19 and connected to vacuum pumps for extracting uncondensable gases.

It should be observed that the branches start from regions of increased thickness such as $e_1$. The branches lead to there being long notches 20 and short notches 21, thereby reducing the overall area required for passing steam.

Because of these subdivisions of the tube-containing spikes 6, 10, 11, 12, etc. . . . , it is thus possible to reduce the thickness of the spikes without reducing the number of tubes, thereby increasing heat exchange. This reduction in spike thickness makes it possible to accept the extra thickness $e_1$ where the branches separate.

The trace of the invention thus makes it possible to install a greater number of tubes in a given area of tube plate while retaining the same dimensioning criteria: 5% to 10% additional tubes can be provided compared with the prior art trace of FIG. 1.

It should also be observed that the efficiency of the tubes is more uniform, and in particular significant clogging at the bases of the spikes is avoided. A drop in condensation pressure of the order of 2 mbars to 3 mbars can be obtained in a 1000 MW condenser.

Figure 3:
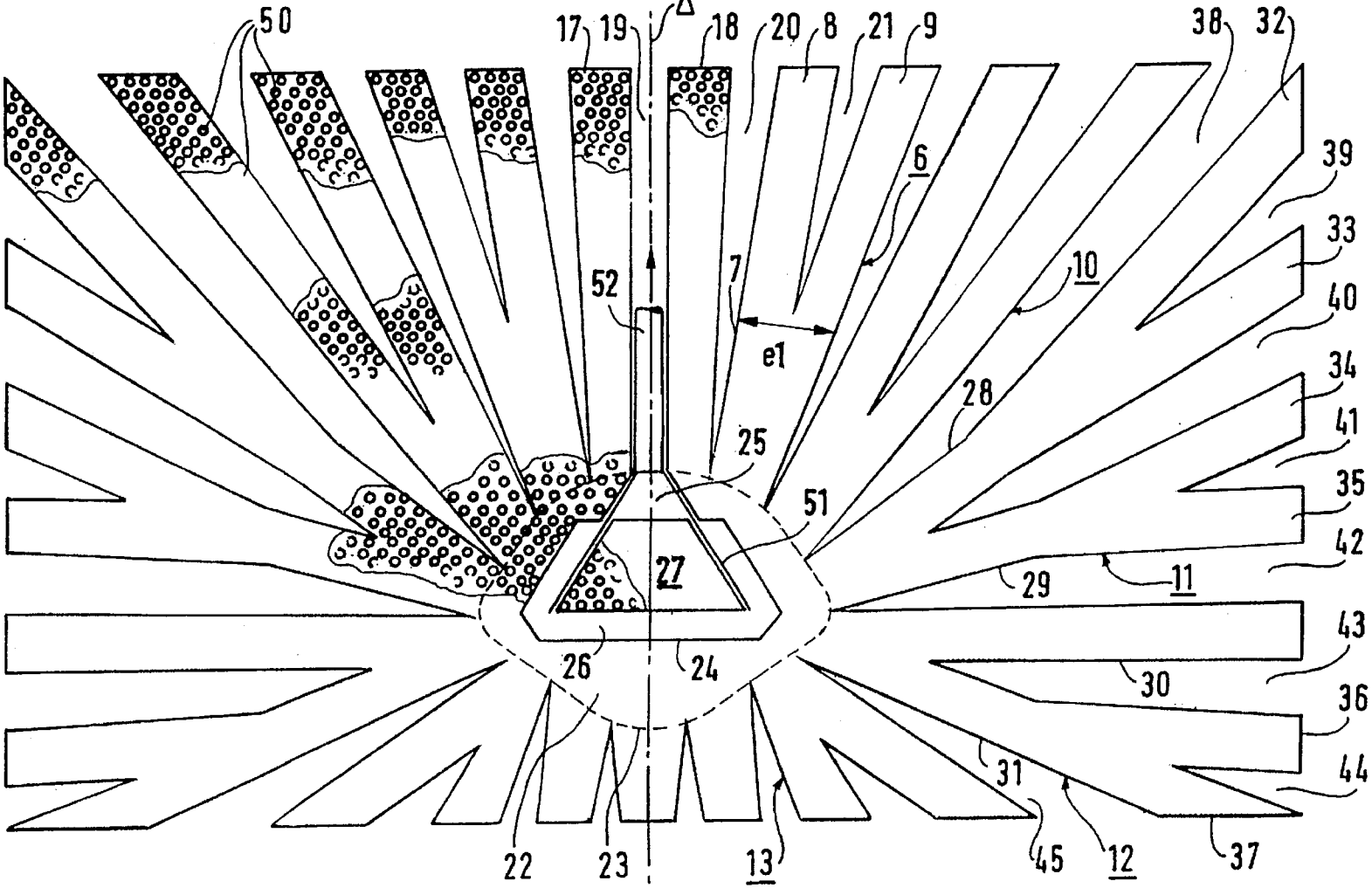

FIG. 3 shows another example of a bundle when the ratio of height over width is equal to 0.6. In this case, it can be seen that the spikes 11 and 12, and the spikes symmetrical thereto about the axis Δ split firstly into pairs of branches 28, 29, and 30, 31, and then split again into two more branches 32, 33 for the branch 28 and 34, 35 for the branch 39. The branch 31 of spike 12 again splits into two branches 36 and 37. Between all of these branches there are notches 38 to 45 of various heights.

Figure 4:
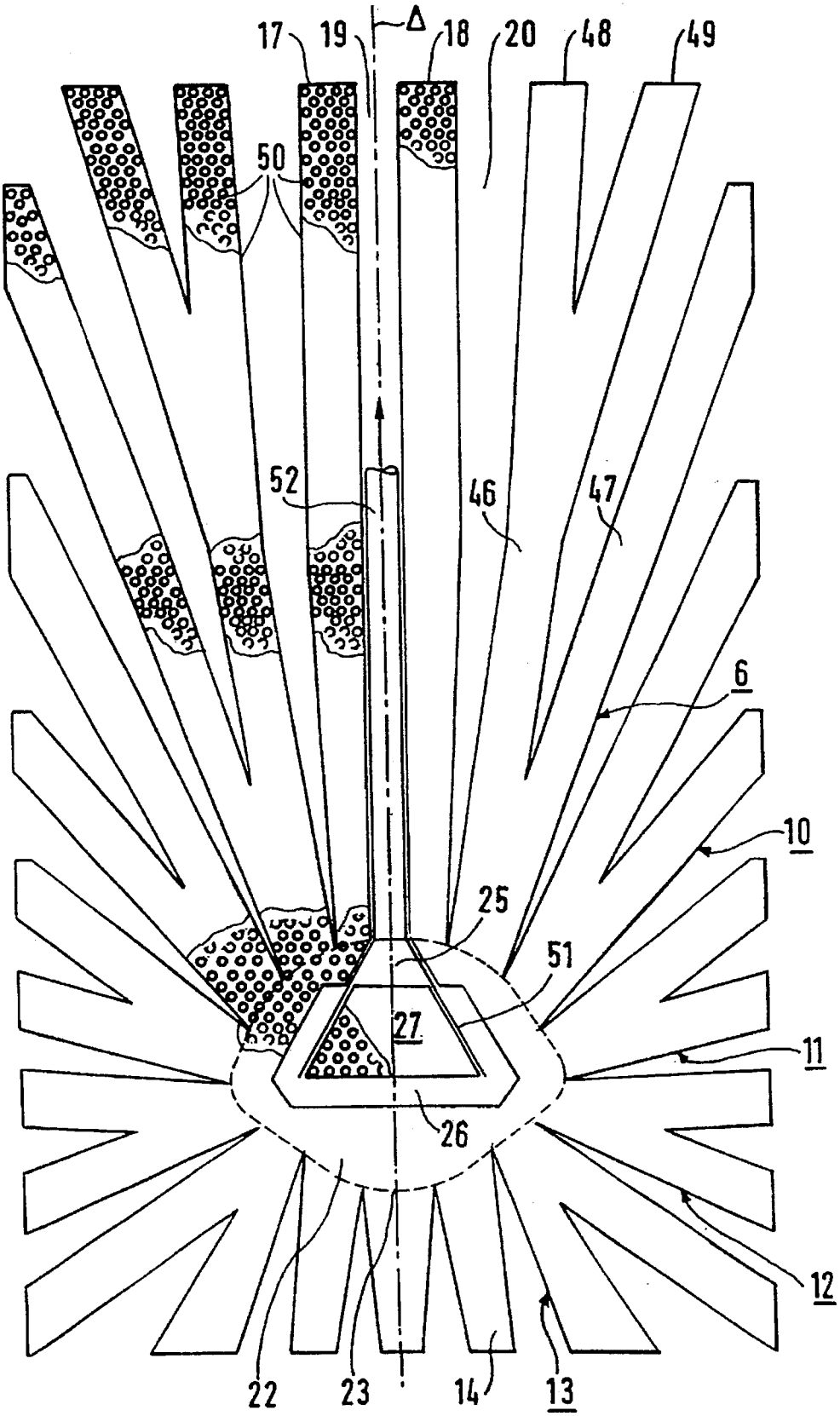

FIG. 4 shows another example in which the ratio of the height over the width of the bundle is equal to 1.7. In this example, spike 6 and the spike symmetrical thereto splits into two branches 46 and 47, and then the branch 46 splits again into two branches 48 and 49.

In general, the tubes are better distributed over the tube plate since the filling coefficient of the peripheral portion thereof is greater, thereby avoiding concentrating or clogging tubes which is unfavorable to heat exchange.

Thus, it has been shown by calculation that in the prior art, for the top spikes, the tubes situated halfway along and at the ends of the spikes constitute 49.3% of the total number of tubes, whereas in the invention, this figure can be raised to 54.6%. The periphery of the plate is thus better occupied.

We claim:

1. A tube bundle for a steam condenser in which the projection on a plane perpendicular to the axis of the tubes of the envelope of the tube-containing zones of the bundle forms a trace of the type forming radiating spikes, wherein at least some of the spikes split at least once into branches, and wherein said spikes radiate from a tube-containing area that forms a substantially circular ring.

2. A bundle of tubes according to claim 1, wherein the branching spikes comprise a base trunk which flares and splits into two branches of equal thickness as soon as the thickness of the trunk of the spike has reached between one-and-a-half and two times the thickness of its base.

3. A bundle of tubes according to claim 1, wherein the thickness of said tube-containing area forming a ring is substantially constant.

4. A bundle of tubes according to claim 1, wherein a tube-containing area of trapezium-shape referred to as the "air cooler" is surrounded by a cowling with the exception of its bottom face, and is situated inside said tube-containing ring, a tube-free annular area separates said trapezium-shaped area from said tube-containing ring, said tube-containing ring includes a gap into which the top end of said cowling penetrates, leaving clearance for communication between the tube-free annular area and a tube-free steam-passing notch between two spikes, and said cowling communicates with a few extraction pipes passing through said notch.

5. A bundle of tubes according to claim 4, wherein said two spikes separated by said notch are non-branched spikes, and wherein said notch is rectangular.

* * * * *